US008601616B2

(12) United States Patent
Radford et al.

(10) Patent No.: US 8,601,616 B2
(45) Date of Patent: Dec. 10, 2013

(54) MENS SUPPORT NETHERGARMENT

(75) Inventors: Sean Colin Radford, London (GB); Lisa Marie Watson, London (GB)

(73) Assignee: Magellan Textile Holdings Limited, Tsimshatsui, Kowloon (HK)

( * ) Notice: Subject to any disclaimer, the term of this patent is extended or adjusted under 35 U.S.C. 154(b) by 856 days.

(21) Appl. No.: 12/091,699

(22) PCT Filed: Oct. 27, 2006

(86) PCT No.: PCT/GB2006/004005

§ 371 (c)(1),
(2), (4) Date: Sep. 30, 2008

(87) PCT Pub. No.: WO2007/049054

PCT Pub. Date: May 3, 2007

(65) Prior Publication Data

US 2011/0307996 A1 Dec. 22, 2011

(30) Foreign Application Priority Data

Oct. 27, 2005 (GB) ..... 0521909.2

(51) Int. Cl.
*A41B 9/02* (2006.01)

(52) U.S. Cl.
USPC ..... 2/403; 2/400; 2/405

(58) Field of Classification Search
USPC ..... 2/400, 403, 69, 67, 227, 228, 238, 405, 2/402, 406, 404, 78.1, 109, 113; 602/67, 602/68, 72, 73, 70; 450/104
See application file for complete search history.

(56) References Cited

U.S. PATENT DOCUMENTS

| | | | | |
|---|---|---|---|---|
| 2,328,953 | A * | 9/1943 | Chatfield et al. | 602/67 |
| 2,624,336 | A * | 1/1953 | Hansley | 602/67 |
| 4,173,976 | A * | 11/1979 | Bloomquist et al. | 602/67 |
| 5,210,882 | A | 5/1993 | Moretz et al. | |
| 6,289,520 | B1 * | 9/2001 | Page | 2/403 |
| 6,353,940 | B1 * | 3/2002 | Lyden | 2/403 |
| 2004/0154078 | A1 | 8/2004 | Auger | |

FOREIGN PATENT DOCUMENTS

| | | | |
|---|---|---|---|
| EP | 1 112 695 | A1 | 7/2001 |
| FR | 2 567 001 | A | 1/1986 |
| FR | 2 621 457 | A | 4/1989 |
| GB | 1 339 861 | A | 12/1973 |
| GB | 1 377 090 | A | 12/1974 |
| GB | 2 366 988 | A | 3/2002 |

OTHER PUBLICATIONS

"Undergarment" [Online], Feb. 21, 2005, XP002413055, retrieved from the Internet: URL:http://www.answers.com/topic/undergarment> [retrieved on Sep. 12, 2012], pp. 1-13.

* cited by examiner

*Primary Examiner* — Khoa Huynh
*Assistant Examiner* — Khaled Annis
(74) *Attorney, Agent, or Firm* — Dickstein Shapiro LLP

(57) ABSTRACT

A mens support nethergarment having a main body for surrounding the lower body of the wearer and a waist opening located at an upper end of the main body. The main body has a front panel section and a rear panel section each formed of knitted or woven fabric. The front and rear panel sections extend downwardly from the waist opening and are joined together to define a crotch region. The front panel section is shaped to define a pouch for containing the genitalia of the wearer.

6 Claims, 2 Drawing Sheets

MENS SUPPORT NETHERGARMENT

This invention relates to in particular, but not exclusively, a support nethergarment for men.

A known support garment used by men, especially athletes, is a jockstrap. A typical jockstrap comprises an elasticated belt from which a narrow strip of fabric depends for supporting a wearer's genitalia. The region of fabric which supports the genitalia is usually an elastically stretchable fabric, which is stretched to accommodate the genitalia in wear, and which applies a compressive force on the genitalia to resist bounce of the genitalia during a sporting exercise.

Such jockstraps, while providing a desired degree of support to the genitalia are often uncomfortable to wear. In addition, jockstraps are unsightly, thereby limiting their use other than for sporting activities.

Therefore it is a general aim of the invention to provide a support garment for men that is more comfortable and aesthetically pleasing than conventional male support garments.

According to one aspect of the invention there is provided a mens support nethergarment having a main body for surrounding the lower body of the wearer, a waist opening located at an upper end of the main body, the main body having a front panel section and a rear panel section each formed of knitted or woven fabric, the front and rear panel sections extending downwardly from the waist opening and being joined together to define a crotch region, the front panel section being shaped to define a pouch for containing the genitalia of the wearer.

The provision of a main body having front and rear panel-sections formed of knitted or woven fabric ensures that the garment is more comfortable to wear and creates less abrasion than, e.g. conventional support garments for men. The pouch is shaped to receive a wearer's genitalia and so is able to support the genitalia without significant stretch of the fabric forming the pouch, i.e. create a pocket in which the genitalia are held relatively steady during physical activity. The garment is able to provide such support more comfortably than, e.g. a garment that uses compression to support a wearer's genitalia. Such garments tend to squash a wearer's genitalia which is uncomfortable.

Preferably the front panel section includes a pair of pouch forming sub-panels extending side by side from the crotch region toward the waist opening, the pair of pouch forming sub-panels being secured together along their inner sides by a seam, the panels and seam being shaped to define said pouch.

Such an arrangement is a convenient way of constructing the garment so as to provide the desired comfort and performance characteristics. The provision of discrete pouch forming sub-panels also allows for these panels to include fabric having differing performance characteristics to that of the remainder of the front section, thereby permitting optimization of the support provided by the pouch.

Optionally the front panel section includes a support sub-panel located to extend along the outer side of the pair of pouch forming panels, adjacent sides of a support sub-panel and a neighbouring pouch forming panel being seamed together.

The inclusion of support sub-panels further assists the garment in providing a desired degree of support. The provision of discrete support sub-panels readily allows for these sub-panels to include fabric having differing performance characteristics to that of the remainder of the front section, thereby permitting optimization of the support and comfort provided by the garment.

In a preferred embodiment of the invention the pouch forming sub-panels are formed from a fabric having a greater degree of stretch than the fabric from which the support sub-panels are made. Imbuing the pouch forming sub-panels with a greater degree of stretch allows the pouch to stretch in order to shape to the contours of a wearer's genitalia, thereby providing improved fit which results in greater comfort. The degree of stretch of the fabric forming the pouch is marginal (i.e. substantially less than) the degree of stretch in conventional jockstraps, which rely upon stretch of the fabric alone to accommodate the full volume of the genitalia.

The fabric of the pouch forming sub-panels may be a non-elasticated fabric or alternatively may be an elasticated fabric by, for example, being knit in part using elastomeric yarns. If the fabric is elasticated, the fabric will impose a degree of compression on the genitalia when it is stretched. However, this degree of compression will be much less than that imposed by conventional jockstraps since the fabric has only been stretched slightly to enlarge the pouch as opposed to being stretched to accommodate the full volume of the genitalia as happens with a conventional jockstrap.

In another preferred embodiment of the invention the support sub-panels are each formed from a fabric having a greater degree elastic recovery than the fabric from which the pouch forming sub-panels are made. This enables the support sub-panels to provide support for the pouch which helps to further hold the wearer's genitalia steady during physical activity.

These arrangements enable the support garment to exhibit desired support and comfort characteristics.

Conveniently the fabric from which the pouch forming sub-panels are formed has an inner surface formed from a moisture absorbent yarn. One such yarn is TACTEL® with a cotton handle. Such an arrangement promotes transfer of moisture from adjacent to a wearer's skin to an exterior of the garment where it more easily evaporates. This helps to further reduce the likelihood of any abrasion occurring between the support garment and a wearer's skin. Consequently the fabric is able to keep a wearer cool and dry. Furthermore, a yarn such as MERYL SKINLIFE® may imbue the pouch forming sub-panels with antibacterial properties.

Preferably the front and rear panel sections have side edges which form therebetween leg openings in order to define a nethergarment in the form of pair of briefs.

Optionally a pair of leg panels depend from the main body in order to define a nethergarment in the form of a pair of shorts.

The foregoing arrangements allow the support garment to resemble conventional underwear, thereby providing the garment with a desired aesthetic appeal which encourages men to wear them.

There now follows a brief description of preferred embodiments of the invention, by way of non-limiting example, with reference being made to the accompanying drawings in which.

Figure 1:
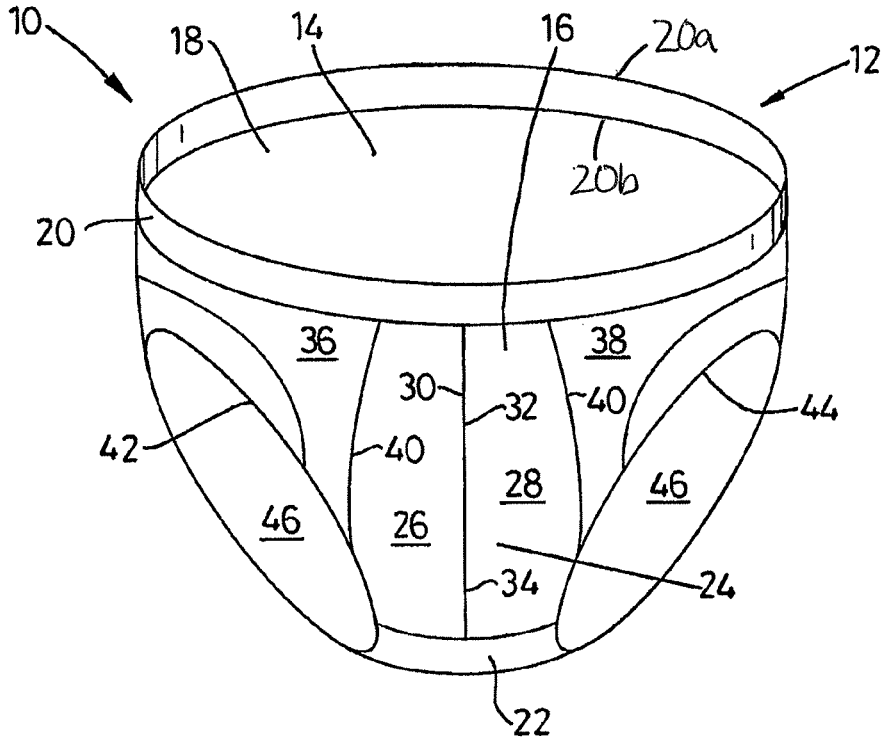
FIG. 1 is a front elevational view of a support nethergarment according to a first embodiment of the invention.
Figure 2:
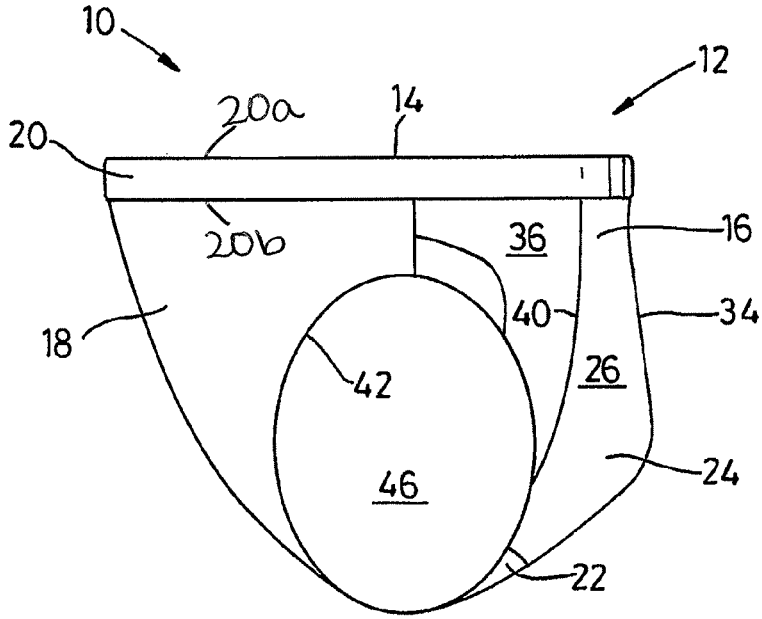
FIG. 2 is an elevational view from a first side of the support nethergarment shown in FIG. 1.
Figure 3:
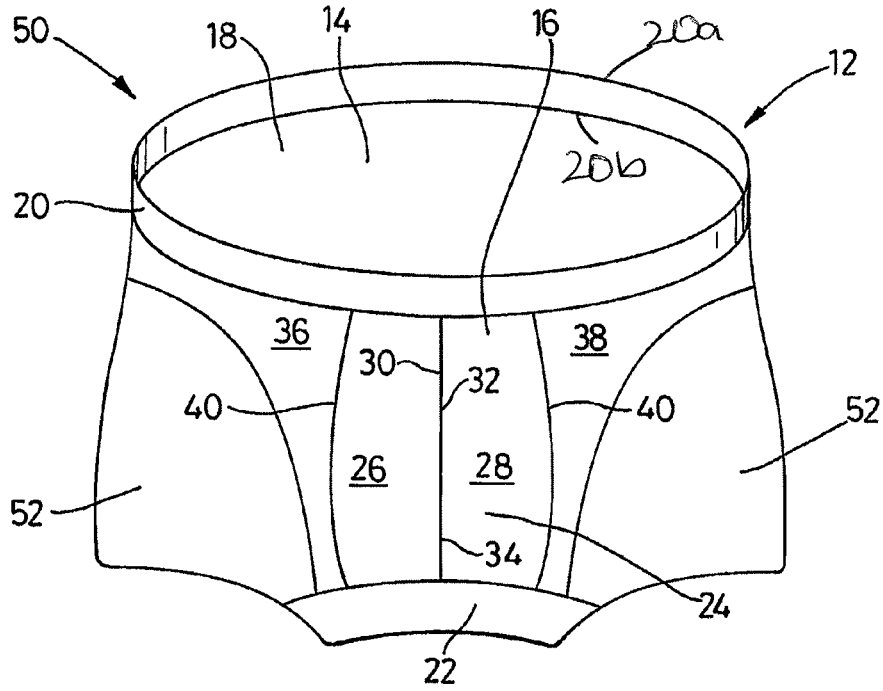
FIG. 3 is a front elevational view of a support nethergarment according to a second embodiment of the invention.
Figure 4:
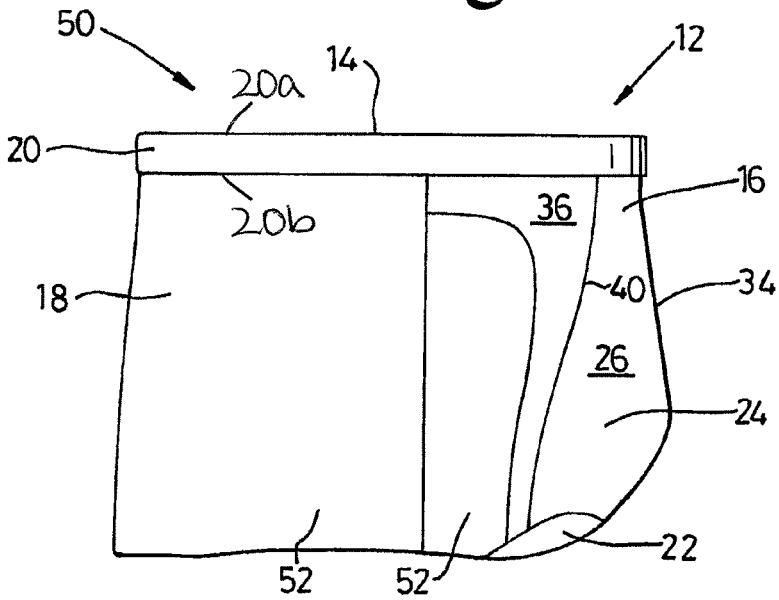
FIG. 4 is an elevational view from a first side of the support nethergarment shown in FIG. 3.

A mens support nethergarment according to a first embodiment of the invention is designated generally by the reference numeral 10. The nethergarment 10 includes a main body 12 which surrounds the lower body of a wearer (not shown). An upper end of the main body 12 includes a waist opening 14.

The main body 12 also includes a front panel section 16 and a rear panel section 18 each formed of a knitted fabric. Preferably, the main body fabric is a single jersey 3 way, plated with elastane and polyamide Meryl Skinlife (Q5443385)PA polyamide Tactel—micro 66% PA polyamide Meryl Skinlife 28% EL elastane 6%. This provides the main body fabric with an advanced functional construction allowing quick drying, moisture management and bacteriostatic effect.

The front and rear panel sections 16, 18 extend downwardly from the waist opening 14. In the embodiment shown the waist opening 14 includes an elasticized waistband 20 which helps retain the nethergarment on a wearer. Waistband 20 has an upper edge 20*a* and a lower edge 20*b*.

The front and rear panel sections 16, 18 join together to define a crotch region 22. The front panel section 16 is shaped to define a pouch 24.

The embodiment shown includes first and second pouch forming sub-panels 26, 28 which extend side by side from the crotch region 22 toward the waist opening 14. The pair of pouch forming sub-panels 26, 28 are secured together along inner sides 30, 32 by a first seam 34. The panels 26, 28 and first seam 34 are shaped so as to define the pouch 24. For example, the inner sides 30, 32 are curved so as to form the pouch 24 when joined together.

The front panel section 16 also includes a support sub-panel 36, 38 extending along each outer side of the pair of pouch forming sub-panels 26, 28. Adjacent sides of each support sub-panel 36, 38 and a neighbouring pouch forming panel 26, 28 are seamed together by respective second seams 40. Each support sub-panel 36, 38 also extends laterally adjacent to the waistband 20 to join with the rear panel section 18.

Shaping each support sub-panel 36, 38 in this way allows them to fit comfortably against a male torso. In addition, integrating the support sub-panels 36, 38 into the garment in this way results in an aesthetically pleasing garment which a user is happier wearing than, e.g. a jockstrap.

Each of the front and rear panel sections 16, 18 has first and second side edges 42, 44 which form therebetween respective leg openings 46. In this way the nethergarment 10 takes the form of a pair of briefs.

In the embodiment shown the pouch forming sub-panels 26, 28 are formed from a fabric having a greater degree of stretch that the fabric from which the support sub-panels 36, 38 are made.

Furthermore, each support sub-panel 36, 38 is formed from fabric having a greater degree of elastic recovery than the fabric from which the pouch forming sub-panels 26, 28 are made.

Preferably the panel support fabric is a modified interlock with elastane and polyamide Meryl Skinlife (Q7542018)PA polyamide Meryl Skinlife 57% PA polyamide Meryl—Micro 28% EL elastane 15%.

The fabric from which the pouch forming sub-panels 26, 28 are formed has an inner surface formed from a fabric having a cotton-like handle. In other embodiments of the invention fabric formed from different moisture absorbent yarns is also possible.

A support nethergarment according to a second embodiment of the invention is designated generally by the reference numeral 50. The second nethergarment 50 shares identical features with the first nethergarment 10. Theses features in the second nethergarment 50 have identical reference numerals.

The second nethergarment 50 includes a pair of leg panels 52 which depend from the main body 12. In this way the second nethergarment 50 takes the form of a pair of shorts.

The invention claimed is:

1. A mens support nethergarment having a main body for surrounding the lower body of the wearer, a waist opening located at an upper end of the main body, the main body having a front panel section and a rear panel section each formed of knitted or woven fabric, a waistband defining the waist opening wherein said waistband is attached to an upper portion of the front and rear panel sections, and said waistband includes an upper edge and a lower edge, the front and rear panel sections extending downwardly from the waist opening and being joined together to define a crotch region, the front panel section including a pair of pouch forming sub-panels arranged side by side and extending longitudinally from the crotch region to the lower edge of the waistband, the pair of pouch forming sub-panels being secured together along their inner sides by a first seam extending longitudinally to the lower edge of the waistband, the pouch forming sub-panels and the first seam being shaped to define a pouch for containing the genitalia of the wearer, and a pair of support sub-panels attached to outer sides of a respective pouch forming sub-panel, to the lower edge of the waistband, and to a corresponding front panel, and extending to the rear panel, each pouch forming sub-panel and a neighbouring support sub-panel being formed from separate panels, and adjacent sides of a support sub-panel and a neighbouring pouch forming sub-panel being sewn together at respective second seams.

2. A nethergarment according to claim 1 wherein the pouch forming sub-panels are formed from a fabric having a greater degree of stretch than the fabric from which the support sub-panels are made.

3. A nethergarment according to claim 1 wherein the support sub-panels are each formed from a fabric having a greater degree elastic recovery than the fabric from which the pouch forming sub-panels are made.

4. A nethergarment to claim 1 wherein the fabric from which the pouch forming sub-panels are formed has an inner surface formed from a moisture absorbent yarn.

5. A nethergarment according to claim 1 wherein the front and rear panel sections have side edges which form therebetween leg openings in order to define a nethergarment in the form of pair of briefs.

6. A nethergarment according to claim 1 wherein a pair of leg panels depends from the main body in order to define a nethergarment in the form of a pair of shorts.

* * * * *

UNITED STATES PATENT AND TRADEMARK OFFICE

CERTIFICATE OF CORRECTION

PATENT NO. : 8,601,616 B2
APPLICATION NO. : 12/091699
DATED : December 10, 2013
INVENTOR(S) : Radford et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1141 days.

Signed and Sealed this
Twenty-first Day of April, 2015

Michelle K. Lee

Michelle K. Lee
*Director of the United States Patent and Trademark Office*